United States Patent [19]

Parienti

[11] Patent Number: 4,856,310

[45] Date of Patent: Aug. 15, 1989

[54] ELECTRONIC LOCK

[76] Inventor: Raoul Parienti, 5, rue de Belgique, 06000 Nice, France

[21] Appl. No.: 186,804

[22] Filed: Apr. 27, 1988

[30] Foreign Application Priority Data

Apr. 29, 1987 [FR] France ..... 87 06276

[51] Int. Cl.[4] ..... E05B 17/04

[52] U.S. Cl. ..... 70/379 R; 70/277

[58] Field of Search ..... 70/277, 278, 276, 379 R, 70/379 A, 380, 279, 280, 281, 282, 221

[56] References Cited

U.S. PATENT DOCUMENTS

| | | | |
|---|---|---|---|
| 3,748,878 | 7/1973 | Balzono | 70/277 |
| 4,326,125 | 4/1982 | Flies | 70/277 |
| 4,340,925 | 7/1982 | Lewiner | 70/282 |
| 4,603,564 | 8/1986 | Kleinberg | 70/380 |
| 4,712,398 | 12/1987 | Clarkson | 70/276 |

FOREIGN PATENT DOCUMENTS

| | | | |
|---|---|---|---|
| 0099762 | 1/1984 | European Pat. Off. . | |
| 8700764 | 7/1988 | France | 70/277 |
| 80434 | 7/1980 | Luxembourg . | |
| 8202811 | 2/1981 | PCT Int'l Appl. . | |
| 2024922 | 6/1978 | United Kingdom . | |

*Primary Examiner*—Robert L. Wolfe

*Attorney, Agent, or Firm*—Schweitzer & Cornman

[57] ABSTRACT

An electronic lock that is equipped to work together with a key equipped with a number of programmable memories, the said lock comprising an activation element, a dormant memory which contains a code, and comparison means to successively compare the said code contained in the dormant memory with the codes contained in the programmable memories of the key, characterized by the fact that it comprises means of engagement between the key and the activation element, an electromagnet equipped to control the said means of engagement as soon as the comparison means have recognized that the code of the key and the code of the lock are identical, and locking means to maintain the means of engagement in the engaged position until the key is withdrawn from the lock.

4 Claims, 3 Drawing Sheets

ELECTRONIC LOCK

BACKGROUND OF THE INVENTION

The present invention concerns an electronic lock, and in particular, such a lock that is equipped to work together with a key equipped with a number of programmable memories, the said lock comprising an activation element, a dormant memory which contains a code, and comparison means to successively compare the said code contained in the dormant memory with the codes contained in the programmable memories of the key.

Such a lock is known, for example, from the French patent application No. 8700764. This application particularly provides the possibility of assuring a power supply to different electronic circuits of the key and of the lock from a battery contained in the key. It also provides that the cylinder of the lock can turn freely when the latter is inactive, and that it does not interact with the bolt until one of the codes of the key has been recognized.

A result of this is that the energy available is necessarily slight, since it must be compatible with the volume and the weight of a key. Therefore, it is not possible to maintain the electronic circuits of the key and the lock in the active state between the time when the code was recognized and when one wishes to maneuver the lock.

SUMMARY OF THE PRESENT INVENTION

The present invention aims to resolve this problem in providing a lock of the type described above, which acts like a conventional lock as soon as the code has been recognized, and in which the sole consumption of energy results from recognition of the code, on the one hand, and instantaneous interaction of the cylinder with the bolt as soon as the code has been recognized, on the other hand.

For this purpose, the invention has as its object an electronic lock that is equipped to work together with a key equipped with a number of programmable memories, the said lock comprising an activation element, a dormant memory which contains a code, and comparison means to successively compare the said code contained in the dormant memory with the codes contained in the programmable memories of the key, characterized by the fact that it comprises means of engagement between the key and the activation element, an electromagnet equipped to control the said means of engagement as soon as the means of comparison have recognized that the code of the key and the code of the lock are identical, and locking means to maintain the means of engagement in the engaged position until the key is withdrawn from the lock.

Such an arrangement comprises a kind of mechanical memory. As soon as one of the codes of the key has been recognized as valid, a single impulse is sufficient to bring the key and the activation element into engagement, with the latter remaining in this position until the key has been withdrawn from the lock.

The key can therefore be activated at any time, without any additional consumption of energy resulting from this.

Another advantage results from such an arrangement. If, in fact, the key is used to lock premises from the inside, it is sufficient to leave it in place to be able to unlock the premises in any circumstance, including a power failure, or failure of the electronic systems, since the lock acts as a conventional lock as long as the key has not been withdrawn.

It can therefore be noted that while the invention is particularly meant for the case where the power supply comes from the key, it also offers major advantages for the security plan in the case where this power supply is effected from the lock.

In one particular embodiment of the invention, the said means of engagement comprise a mobile element which rotates together with the key and can be brought into an engagement position with the activation element under the effect of elastic means when the electromagnet is active, the said mobile element being equipped so as to prevent the electromagnet from returning to the inactive position as long as this mobile element is in the engagement position.

More particularly, the lock according to the invention can comprise a locking element equipped so as to be displaced by the key against the action of elastic means, from a position in which it prevents the mobile element from going into an engagement position to a position in which it allows the release of the mobile element by the electromagnet.

In the following, a particular embodiment of the invention will be described, as a non-limiting example, with reference to the schematic drawings attached, where:

DETAILED DESCRIPTION OF INVENTION

Figure 1B:
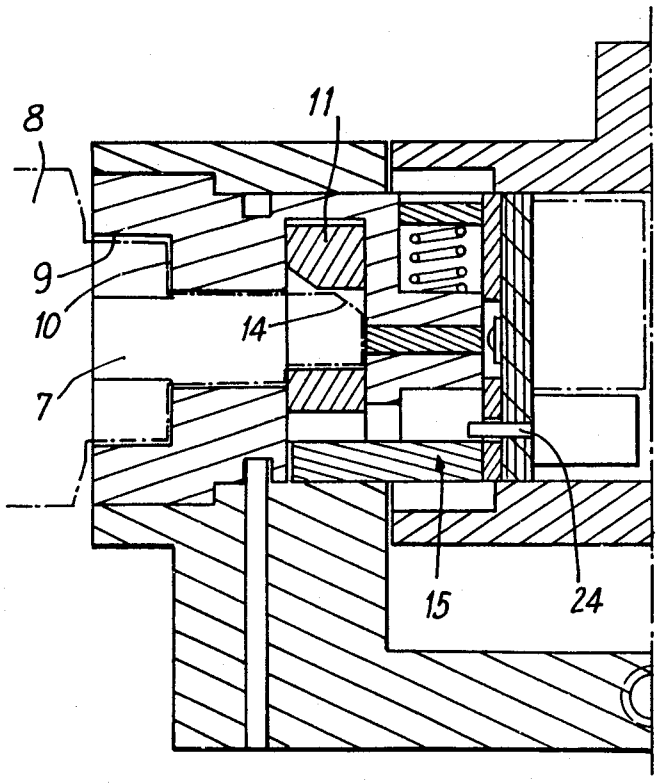
FIGS. 1A to 1E are vertical axial cross-sections of a half-lock according to the invention, illustrating the different stages of its operation.

The half-lock shown in the drawings comprises, in a general manner, a barrel 1, in the interior of which a cylinder 2 is installed so that it rotates and is held axially by means of a pin 3 which acts together with a groove 4. The other half-lock is symmetrical to this in such a manner as to allow locking and unlocking of one or the other side of the door on which the lock is installed.

An activation element 5 is also installed to rotate on the barrel 2, and is equipped with a drive pin 6 to drive the bolt (not shown) of the lock.

The cylinder 2 comprises an orifice 7 to receive a key 8 (FIG. 1B), this orifice comprising notches 9 which can act together with the projections 10 of the key, to allow the barrel to be driven in rotation under the action of the key.

The key 8 comprises, as described in the aforementioned French patent application, a battery for electrical feed of its own circuits and those of the lock, as well as a unit of programmable memories which contain codes.

A locking element 11 is installed so that it moves in a cavity of the cylinder 2, to be displaced by translation, upwards in the figures, against the action of the two helicoidal springs 12, arranged in compression between the element 11 and the cylinder 2. This locking element comprises an inclined plane 13 which can act together with a corresponding inclined plane 14 of the key in such a way that as soon as the key is introduced, it pushes the element 11 upwards by compressing the springs 12.

The lock also comprises a mobile element 15 which moves in the cylinder 2, which can be displaced upwards under the effect of a helicoidal spring 16 compressed between this mobile element and the cylinder 2.

The springs 12 possess a greater rigidity than the spring 16, because they are exposed afterwards.

The mobile element 15 comprises an end part 17 located at the side of the spring and equipped to engage in recesses 18 of the drive element 5 under the effect of the spring 16, after it has been released as will be described below.

In the rest position of the lock represented in FIG. 1A, the mobile element 15 is held in its low position against the action of the spring 16, as will be described below, and the locking element 11 is held in its low position by the springs 12, against the mobile element 15.

The lock also comprises an optic fiber 19 equipped to transmit the codes contained in the programmable memories of the key to an electronic circuit 20 by way of a reception cell 21.

As also described in the aforementioned French patent application, the electronic circuit 20 comprises at least one dormant memory which contains a characteristic code of the lock, and means for comparing this code with the codes received from the key.

The electronic circuit 20 is installed on a circuit board 22 which also holds an electromagnet 23, the plunger 24 of which is arranged in such a manner that when the electromagnet 23 is not active, the plunger acts together with a surface of the mobile element 15 to hold the latter and prevent it from being displaced upwards under the effect of the spring 16.

Finally, two electrical connections 25 surrounded by an insulating sleeve 26 are arranged in the cylinder 2 to assure the supply of electrical power to the electronic circuit 20 from the battery contained in the key.

Figure 1A:
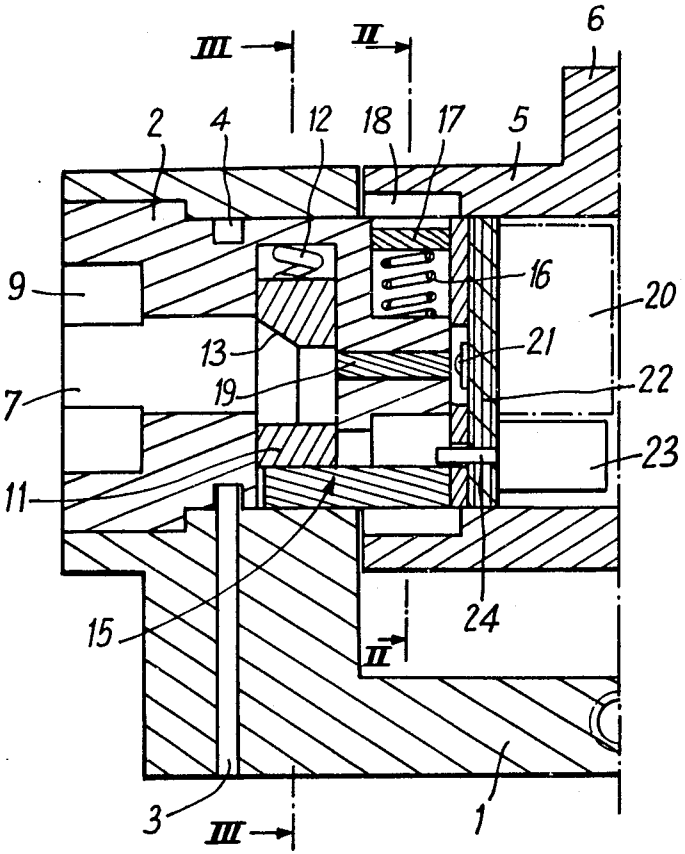

It will be noted that in the position shown in FIG. 1A, the cylinder 2 can turn freely within the barrel 1 of the lock, without driving the activation element 5, which greatly limits the risk of break-in.

When the key 8 is introduced into the orifice 7, as shown in FIG. 1B, it pushes the locking element 11 upwards, thereby permitting release of the mobile element 15 by the plunger 24.

The codes contained in the programmable memories of the key are then addressed successively to the electronic circuit 20, which compares them with the code contained in its dormant memory, until the two codes are recognized as being identical. An impulse is then applied to the electromagnet 23, which causes retraction of the plunger 24 as shown in FIG. 1C, which thus completely releases the mobile element 15.

Figure 1D:
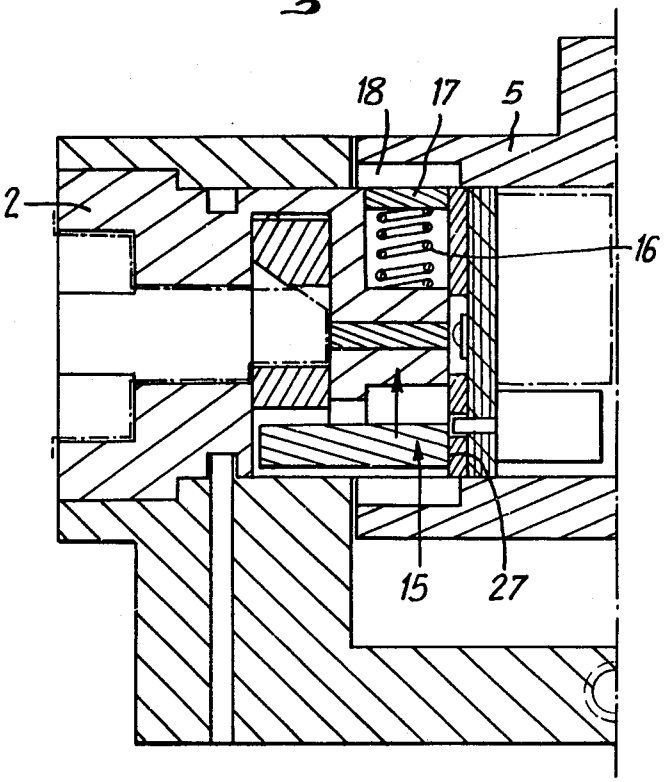
Figure 1C:
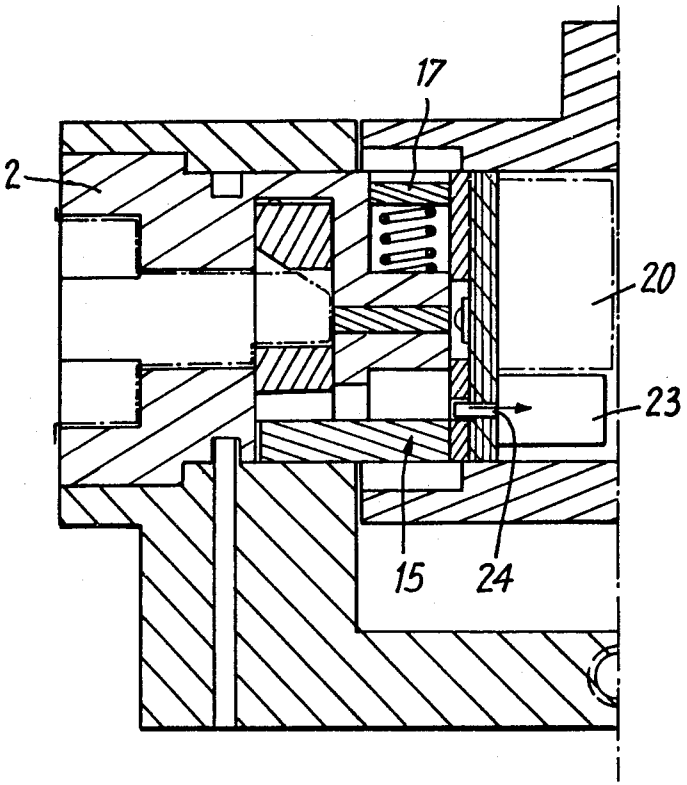
Figure 1E:
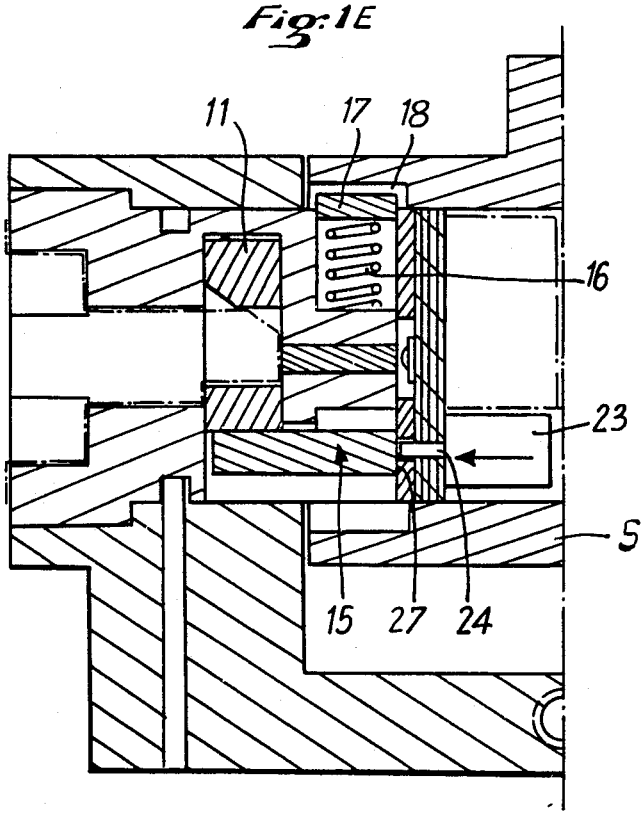
Figure 2:
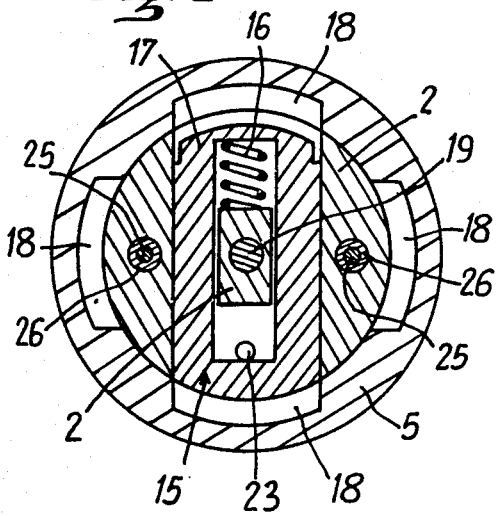
FIG. 2 is a cross-sectional view according to the line II—II of FIG. 1A.
Figure 3:
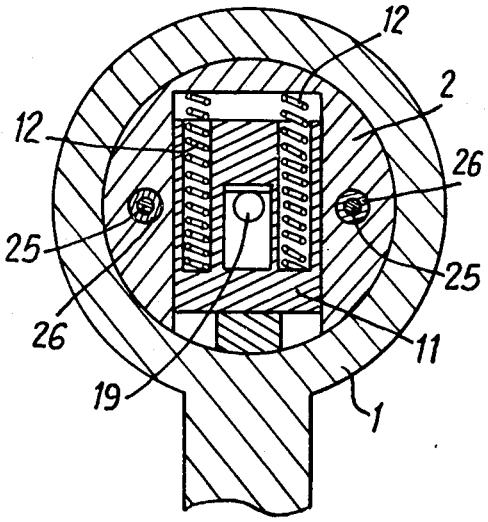
FIG. 3 is a cross-sectional view according to the line III—III of FIG. 1A.

The latter then starts to move upwards as shown in FIG. 1D. If the part 17 of the element is not across from a recess 18 of the activation element 5, it rests against the interior surface of the latter, as is the case in FIG. 1D. It is then sufficient to cause a slight rotation of the barrel using the key, equal to a maximum of one-quarter turn, in order for the part 17 of the element 15 to engage in one of the recesses 18, thereby bringing the key and the activation element together as a unit by the intermediary of the barrel 2 and the element 15.

It will be noted that as soon as the mobile element 15 has started to move upwards, the plunger 24 of the electromagnet 23 can no longer return to its inactivated position, so that a single short impulse applied to the electromagnet 23 is sufficient to cause engagement of the key with the activation element 5.

In fact, the end of the plunger is then resting against a frontal surface 27 of the mobile element 15, which prevents it from exiting from the body of the electromagnet 23.

It is only when the key is withdrawn from the lock that the locking element 11 is released, so that the latter goes back into its initial position under the effect of the springs 12, driving the mobile element 15 downwards against the effect of the spring 16. The greater rigidity of the springs 12 allows this movement.

When the mobile element returns to its initial position, it releases the plunger 24 which returns to its initial position, thus preventing the barrel 2 from engaging with the activation element 5 until a new impulse is applied to the electromagnet 24.

It is understood that various variations and modifications can be made in the preceding description, without thereby leaving the scope or the spirit of the invention.

In particular, it has not been a question of a single dormant memory containing a single code in the electronic circuit 20. It is understood that this electronic circuit could contain several codes which can be activated selectively, at the option of the owner of the lock.

I claim:

1. An electronic lock that is programmed to be operated by a key having a number of programmable memories, said lock comprising an activation element (5), a dormant memory which contains a code, and comparison means to successively compare said code contained in the dormant memory with the codes contained in the programmable memories of the key, characterized by the fact that said lock comprises means of engagement (2, 15, 17) between the key and the activation element, an electromagnet (23) controlling said means of engagement by a single impulse as soon as the comparison means have recognized that the code of the key and the code of the lock are identical, and locking means (27) maintaining the means of engagement in the engaged position until the key is withdrawn from the lock, said lock being operable as a conventional lock as long as said key is not withdrawn.

2. A lock according to claim 1, characterized by the fact that its electrical power is supplied from the key.

3. A lock according to claim 1, characterized by the fact that the means of engagement comprise a mobile element (15) which rotates together with the key and can be brought into an engagement position with the activation element under the effect of elastic means (16) when the electromagnet is active, the said mobile element being equipped so as to prevent the electromagnet from returning to the inactive position as long as this mobile element is in the engagement position.

4. A lock according to claim 3, characterized by the fact that it comprises a locking element (11) equipped to be displaced by the key against the action of elastic means (12), from a position in which it prevents the mobile element from going into an engagement position to a position in which it allows the release of the mobile element by the electromagnet.

* * * * *